US008092156B2

(12) United States Patent
Jang et al.

(10) Patent No.: US 8,092,156 B2
(45) Date of Patent: Jan. 10, 2012

(54) OUTDOOR UNIT OF AIR CONDITIONER

(75) Inventors: Seok Hoon Jang, Gimhae-si (KR); Byoung Sup Kim, Gimhae-si (KR); Joon Hyuk Kwon, Changwon (KR); Woong Seok Noh, Namyangju-si (KR); Eun Seong Pack, Busan (KR)

(73) Assignee: LG Electronics Inc., Seoul (KR)

( * ) Notice: Subject to any disclaimer, the term of this patent is extended or adjusted under 35 U.S.C. 154(b) by 939 days.

(21) Appl. No.: 12/081,401

(22) Filed: Apr. 15, 2008

(65) Prior Publication Data

US 2009/0108717 A1 Apr. 30, 2009

(30) Foreign Application Priority Data

Oct. 31, 2007 (KR) ..... 10-2007-0110629

(51) Int. Cl.
*F04D 29/58* (2006.01)

(52) U.S. Cl. ..... 415/121.2; 416/247 R

(58) Field of Classification Search ..... 415/121.2, 415/121.3; 416/247 R; 417/423.15, 360
See application file for complete search history.

(56) References Cited

U.S. PATENT DOCUMENTS

| | | | | |
|---|---|---|---|---|
| 4,313,417 | A * | 2/1982 | Briggs et al. | 126/110 B |
| 4,774,030 | A * | 9/1988 | Kinkel et al. | 261/29 |
| 5,117,656 | A * | 6/1992 | Keck et al. | 62/506 |
| 6,022,200 | A * | 2/2000 | Myers | 417/423.15 |
| 6,229,236 | B1 * | 5/2001 | Fisher et al. | 310/89 |
| 6,589,018 | B2 * | 7/2003 | Chen | 417/14 |
| 6,979,169 | B2 * | 12/2005 | Penlesky et al. | 415/1 |
| 7,191,613 | B2 * | 3/2007 | Lee | 62/262 |
| 2009/0277205 | A1 * | 11/2009 | Matsuda et al. | 62/259.1 |

FOREIGN PATENT DOCUMENTS

| | | | |
|---|---|---|---|
| CN | 1553112 | | 12/2004 |
| CN | 1782553 | | 6/2006 |
| JP | 9-310890 | | 12/1997 |
| JP | 2006292196 | A * | 10/2006 |
| JP | 2007147250 | * | 6/2007 |

OTHER PUBLICATIONS

Ishizone Tsukasa, "Outdoor Unit for Air Conditioner" Oct. 26, 2006, Abstract for JP2006292196A.*

* cited by examiner

*Primary Examiner* — Edward Look
*Assistant Examiner* — Liam McDowell
(74) *Attorney, Agent, or Firm* — McKenna Long & Aldridge LLP

(57) ABSTRACT

An outdoor unit of an air conditioner is provided. The outdoor unit includes a base assembly defining a lower exterior of the outdoor unit and supporting a plurality of parts, left and right panels that are provided on the base assembly to define left and right exteriors of the outdoor unit, a pair of top panels that are provided between upper ends of the left and right panels to define a top exterior of the outdoor unit, a blower assembly including a blower fan generating air current and a motor providing a torque to the blower fan, a frame assembly supporting the blower assembly and including a pair of transverse supports interconnecting the left and right panels and a motor mount disposed between the pair of transverse supports to support the motor, and a shroud enclosing the blower fan and the motor and guiding airflow generated by the blower fan. The motor mount is received to an inside of the shroud.

10 Claims, 5 Drawing Sheets

OUTDOOR UNIT OF AIR CONDITIONER

The present application claims priority to Korean Patent Application No. 10-2007-0110629, filed Oct. 31, 2007, which is hereby incorporated by reference in its entirety.

BACKGROUND

The present disclosure relates to an outdoor unit of an air conditioner, which is configured such that parts thereof can be conveniently assembled.

In general, an air conditioner is a cooling/heating system that cools an indoor environment by continually performing a cycle of suctioning warm air from the indoor environment, performing heat exchange between the air and cold refrigerant, and expelling the cooled air back into the indoor environment. For heating, reverse conditions are employed to heat the indoor environment. The air conditioner defines a series of cycles using a compressor, condenser, expansion valve, and evaporator.

The typical air conditioners may be divided largely into split type air conditioners with outdoor and indoor units that are installed separately from each other, and integrated type conditioners with the outdoor and indoor units that are integrally installed with each other.

A relatively recent phenomenon is the widespread use of multi-unit air conditioners that are effectively applied in households wanting to install two or more air conditioners, and in buildings with multiple offices that require respective air conditioners. The multi-unit air conditioner connects one outdoor unit to a plurality of indoor units to achieve the same effect as a case where a plurality of the split type air conditioners are installed.

However, the typical air conditioners have limitations in that it is difficult to assemble parts such as a blower fan and a motor and noise may be generated as the flow of the air that is introduced into the outdoor unit and discharged to an external side is not effective.

SUMMARY

Embodiments provide an outdoor unit of an air conditioner that is adapted such that parts thereof can be conveniently assembled.

Embodiments also provide an outdoor unit of an air conditioner that is configured to enable air to be effectively introduced into the outdoor and discharged out of the outdoor.

In an embodiment, an outdoor unit for an air conditioner includes a base assembly defining a lower exterior of the outdoor unit and supporting a plurality of parts; left and right panels that are provided on the base assembly to define left and right exteriors of the outdoor unit; a pair of top panels that are provided between upper ends of the left and right panels to define a top exterior of the outdoor unit; a blower assembly including a blower fan generating air current and a motor providing a torque to the blower fan; a frame assembly supporting the blower assembly and including a pair of transverse supports interconnecting the left and right panels and a motor mount disposed between the pair of transverse supports to support the motor; and a shroud enclosing the blower fan and the motor and guiding airflow generated by the blower fan, wherein the motor mount is received to an inside of the shroud.

In another embodiment, an outdoor unit of an air conditioner includes left and right panels that are provided on the base assembly to define left and right exteriors of the outdoor unit; a pair of top panels that are provided between upper ends of the left and right panels to define a top exterior of the outdoor unit; a pair of transverse supports interconnecting the left and right panels; a motor mount that is disposed between the pair of transverse supports to support the motor; and a shroud enclosing the blower fan and the motor and guiding airflow generated by the blower fan, wherein the motor mount is received to an inside of the shroud; and the top panel is provided with an air outlet through which air is discharged and a polygonal outlet grill for preventing foreign substances from entering is provided above the air outlet.

According to the embodiments, the motor seating plate is provided with an air hole along which air flows. A distance between adjacent circular ribs defining a top surface of the outlet grill is greater than a distance between adjacent side ribs defining a side surface of the outlet grill. Therefore, the air can be effectively discharged and noise can be reduced.

In addition, since a guide stopper is formed to protrude upward from each other motor bracket and catch the motor seating plate. Therefore, the motor seating plate can be disposed at a right position.

Further, the motor seating plate is provided with a wire passing groove. Therefore, the installation of the wire for supplying electric power to the motor can be effectively realized and the damage of the wire can be prevented.

Furthermore, front and rear ends of the shroud is securely fixed on the frame assembly by, for example, screws in a state where the shroud is first hooked on the frame assembly. Therefore, the process for fixing the shroud can be easily performed.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Figure 1:
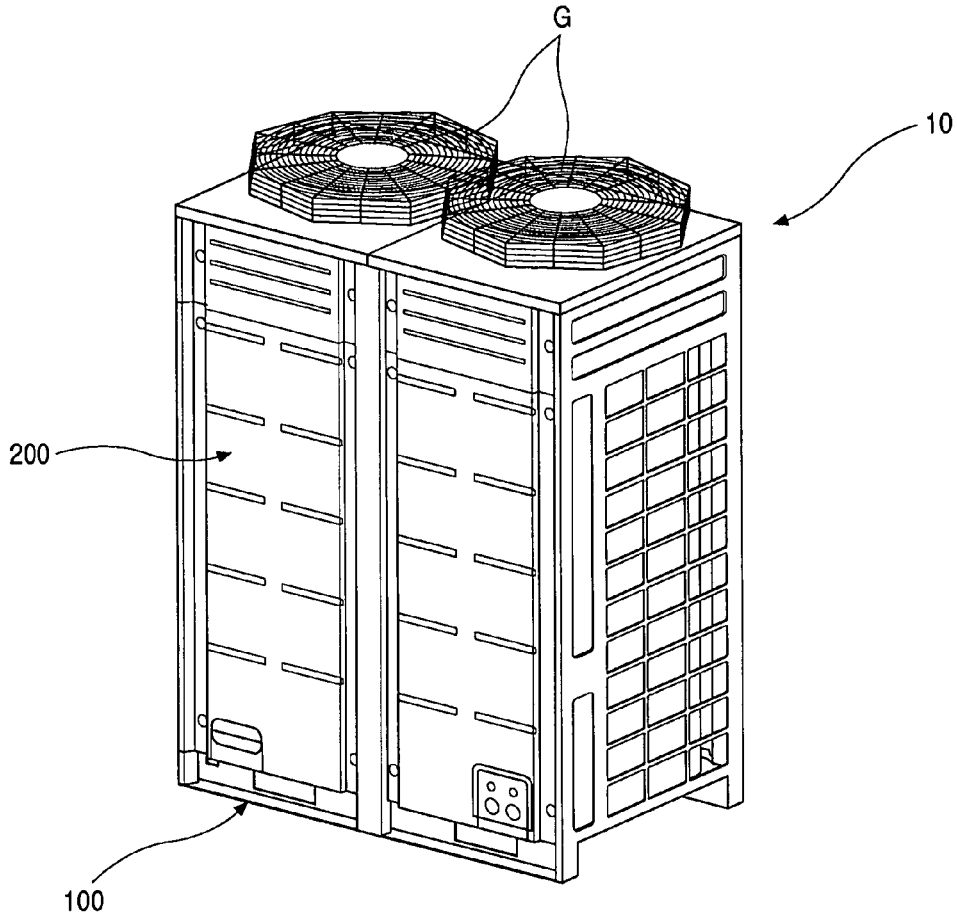
FIG. 1 is a perspective view of an outdoor unit according to an exemplary embodiment of the present disclosure.

FIG. 1 is a perspective view of an outdoor unit according to an exemplary embodiment of the present disclosure. Specifically, FIG. 1 exemplarily shows a type of outdoor unit for an air conditioner that discharges air upwards.

As shown in FIG. 1, the outdoor unit 10 is formed in a box shape and connected through pipes to a plurality of indoor units (not shown). Refrigerant flows between the outdoor and indoor units.

The outdoor unit 10 includes a base assembly 100 defining a lower exterior and a cabinet 200 defining an upper exterior.

That is, the cabinet 200 is disposed on the base assembly 100. The outdoor unit 10 further includes an outlet grills G having an octagonal shape (when viewed from a top) and protruding upward from a top surface of the cabinet 200. The air is discharged out of the outdoor unit 10 through the outlet grills G.

Figure 2:
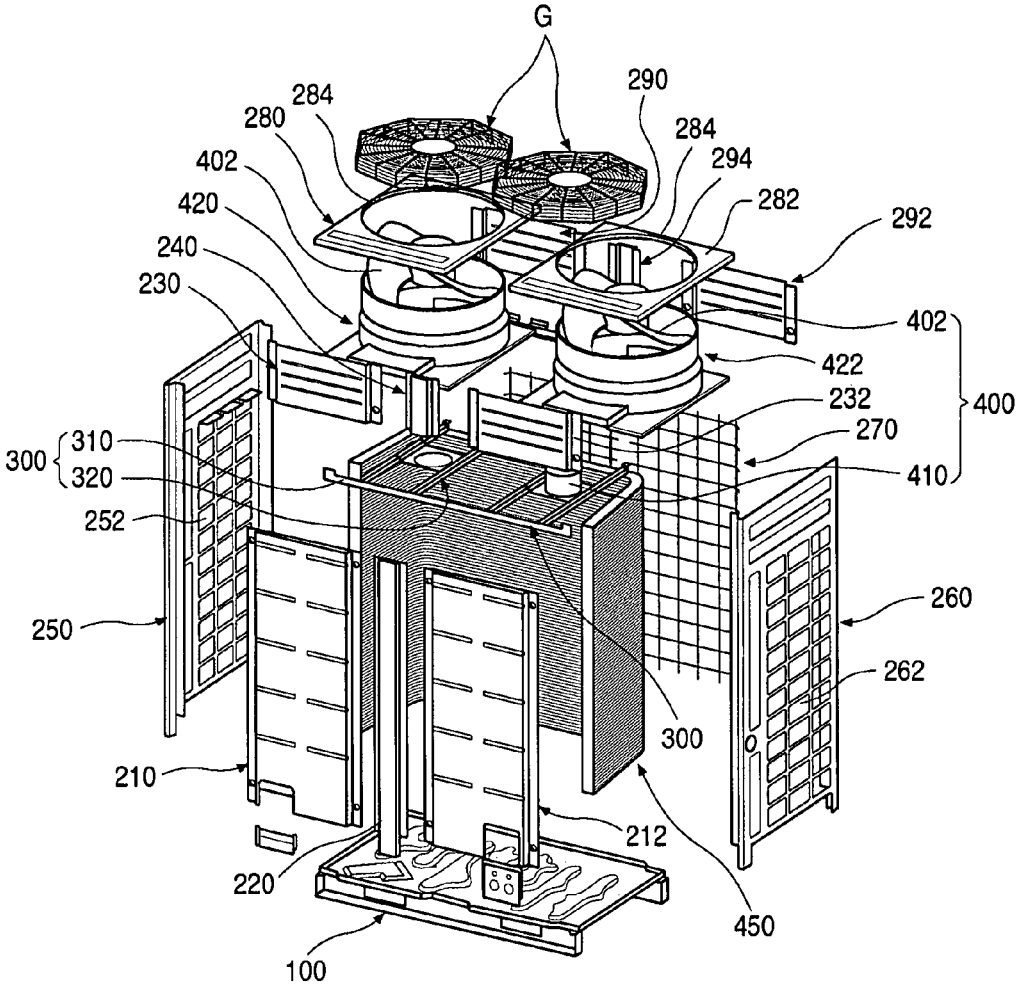
FIG. 2 is an exploded perspective view of the outdoor unit of FIG. 1.

FIG. 2 is an exploded perspective view of the outdoor unit 10.

As shown in FIG. 2, the cabinet 200 is formed with a plurality panels. In more detail, the cabinet 200 includes a pair of front panels 210 and 212 that are provided at a front end of the base assembly 100 to define a front exterior of the outdoor unit. That is, the front panels 210 and 212 are respectively installed on left and right sides at the front end of the base assembly 100. A front center frame 220 is vertically elongated between the front panels 210 and 212.

The cabinet 200 further includes a pair of front upper panels 230 and 232 provided above the respective front panels 210 and 212. The front upper panels 230 and 232 define a front upper exterior of the outdoor unit and are installed at the left and right above the respective panels 210 and 212, respectively. A front upper frame 240 is further provided between the front upper panels 230 and 232. The front upper frame 240 is shaped correspondingly to the front center frame 220 to support the pair of front upper panels 230 and 232.

A left panel 250 and a right panel 260 are respectively provided at the left and right ends of the base assembly 100, defining left and right external facets of the outdoor unit. Also, a left grill 252 is integrally formed with the left panel 250, and a right grill 262 is integrally formed with the left panel 260. Thus, external air is able to enter the outdoor unit 10 through the left and right grills 252 and 262.

A pair of rear grills 270 is provided at an upper rear end of the base assembly 100. The rear grills 270 define the rear exterior surface, and the external air also enters the outdoor unit 10 through the rear grills 270.

A rear center frame (not shown) corresponding to the front center frame 220 is further provided at a central portion of the rear grills 270 to support the pair of rear grills 270.

A pair of top panels 280 and 282 is provided between top ends of the left and right panels 250 and 260 to define the top exterior of the outdoor unit. That is, the external top surface of the outdoor unit 10 is defined by the rectangular left top panel 280 and right top panel 282. An outlet 284 is defined vertically through each of the pair of top panels 280 and 282.

Also, outlet grills G are installed on the outlets 284. The outlet grills G prevent impurities from the outside from entering through the outlets 284, and also allow the air to be discharged upwards out of the outdoor unit.

A pair of rear upper panels 290 and 292 is further provided at the top of the pair of rear grills 270. The rear upper panels 290 and 292 define the rear upper exterior of the outdoor unit, and are formed to have a shape corresponding to the front upper panels 230 and 232.

Accordingly, the rear upper panels 290 and 292 are respectively disposed at left and right sides, and a rear upper frame 294 is further provided between the rear upper panels 290 and 292. The rear upper frame 294 is formed in a shape corresponding to the front upper frame 240, and supports the pair of rear upper panels 290 and 292.

A frame assembly 300 is provided within the cabinet 200. The frame assembly 300 is installed on upper ends of the front panels 210 and 212 to support shrouds 420 and 422, a blower fan 400, and other components, which will be described below.

In more detail, the frame assembly 300 serves to support a blower fan assembly 400 and related parts. The blower assembly 400 includes a pair of longitudinal supports 310 interconnecting the left and right panels 250 and 260 and a pair of motor mounts 320 that are installed between the pair of longitudinal supports 310 to support a motor that will be described below.

The blower assembly 400 is installed above the frame assembly 300. The blower assembly 400 includes a pair of blower fans 402 generating air current and a pair of motors 410 providing torque to the blower fans 402.

The pair of blower fans 402 is enclosed by a pair of shrouds 420 and 422. That is, the shrouds 420 and 422 having the same shape are installed at right and left sides above the frame assembly 300. The blower fans 402, the motors 410, and the motor mounts 320 are disposed to the inside of the pair of shrouds 420 and 422.

In more detail, the shrouds 420 and 422 serve to guide the flow of the air expelled by the blower fans 402. The shrouds 420 and 422 are configured to enclose the flow fans 402 and the motors 410.

A heat exchanger 450 is installed in the cabinet 200. The heat exchanger 450 functions to exchange heat between refrigerant flowing therein and air from the outside, and is installed over the upper left end, rear end, and right end of the base assembly 100. That is, the heat exchanger 450 is formed in a '∩' shape as shown (when viewed from above).

Figure 3:
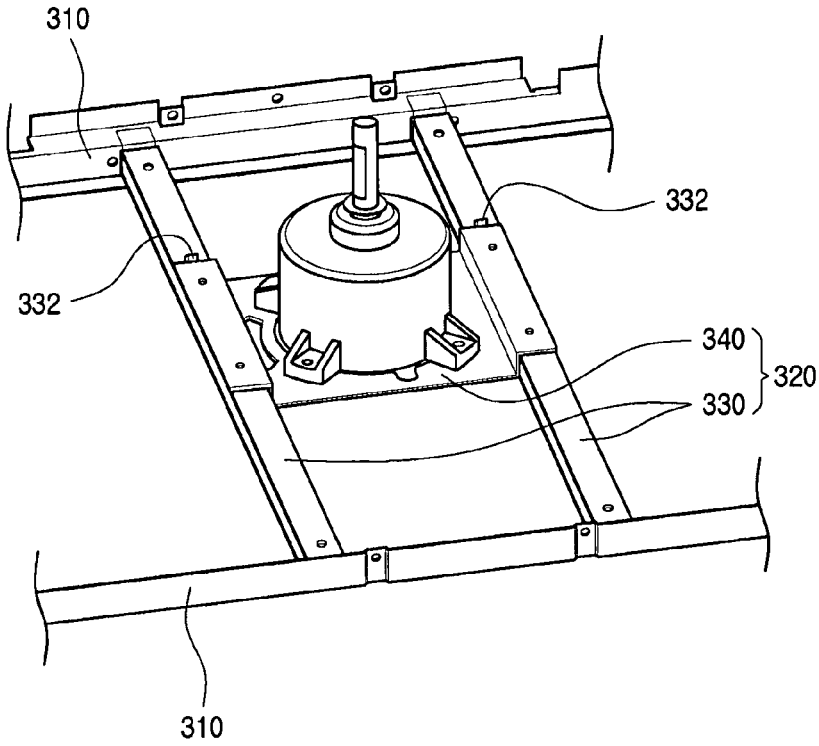
FIG. 3 is a perspective view illustrating a mounting state of a motor on a frame assembly depicted in FIG. 2.

FIG. 3 is a perspective view illustrating a mounting state of the motor 410 on the frame assembly 300.

Referring to FIG. 3, the motor mount 320 includes a pair of transverse motor brackets 330 that are installed between the longitudinal supports 310 to interconnect the pair of longitudinal supports 310 and a motor seating plate 340 disposed between the motor brackets 330.

The motor brackets 330 are spaced apart from each other and arranged perpendicular to the longitudinal supports 310. The motor seating plate 340 is formed in a rectangular shape and stepped at left and right ends thereof. Therefore, the left and right ends of the motor seating plate 340 are fixed on the pair of motor brackets 330, respectively. In this state, the motor 410 is installed at the central portion of the motor seating plate 340.

Each of the motor brackets 330 is provided with a guide stopper 332 protruding upward. The guide stoppers 332 serve to guide the motor seating plate 340 to a right position by catching the motor seating plate 340. The guide stoppers 332 are formed at relatively rear portions of the respective motor brackets 330. Therefore, when a worker pushes the motor seating plate 340 rearward in a state where the motor seating plate 340 is disposed on the motor brackets 330, the motor seating plate 340 is caught by the guide stoppers 332 at the right position.

Figure 4:
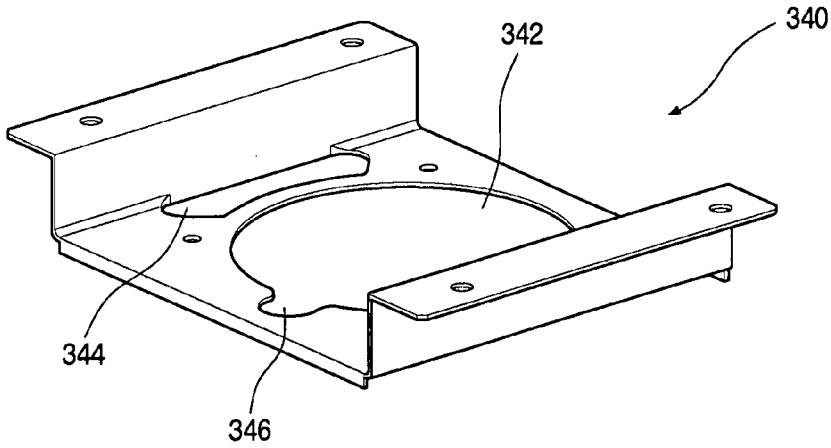
FIG. 4 is a perspective view of a motor seating plate depicted in FIG. 3.

FIG. 4 is a perspective view of the motor seating plate 340.

With reference to FIG. 4, opposite ends of the motor seating plate 340 are stepped upward. The motor seating plate 340 is provided with a motor opening 342 in which the motor 410 is installed and an air hole 344 through which the air passes.

A lower end of the motor 410 is fixedly received in the motor opening 342 formed at a central portion of the motor seating plate 340. The motor opening 342 is formed in a circular shape. The air hole 344 is formed apart from the motor opening 342 to guide the flow of the air upward and downward. That is, even when the motor 410 is installed on the motor seating plate 340, the air hole 344 allows the air to flow through the motor seating plate 340.

An electric wire passing groove 346 is formed on a portion of the motor opening 342. That is, the electric wire passing groove 346 having a predetermined size extends from a front end of the motor opening 342. An electric wire for supplying electric power to the motor 410 is arranged through the electric wire passing groove 346.

Figure 5:
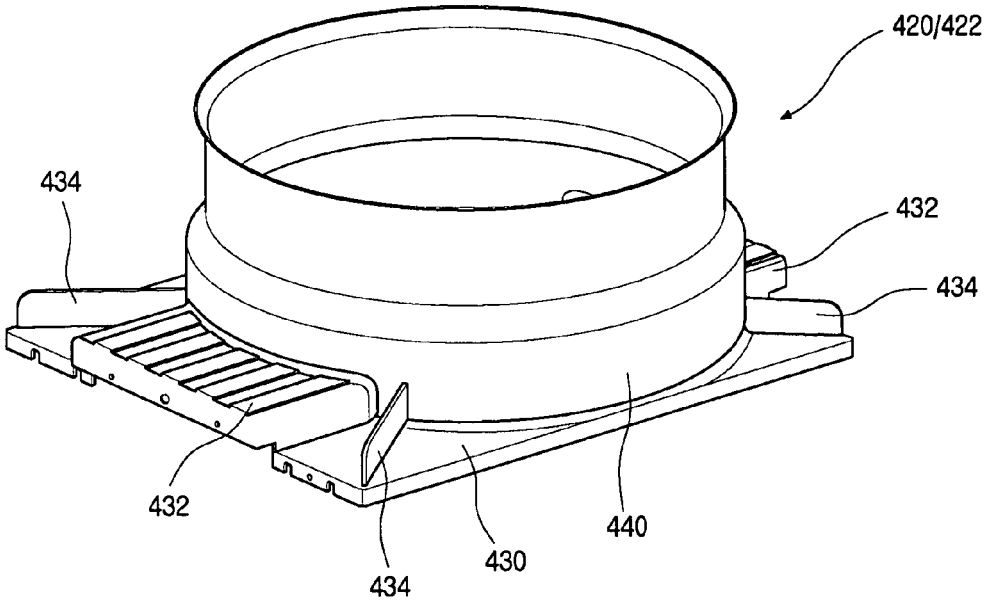
FIG. 5 is a perspective view of the shroud depicted in FIG. 2.

FIG. 5 is a perspective view of the shroud 420, 422.

As shown in FIG. 5, the shroud 420, 422 includes a supporting plate 430 mounted on the frame assembly 300 and a circular air guide 440 protruding upward from a central portion of the supporting plate 430. The supporting plate 430 is formed in a rectangular shape and the air guide 440 is formed in a cylindrical shape to guide the airflow.

The supporting plate 430 is provided with bracket receiving portions 432 elevated. That is, as shown in FIG. 5, the bracket receiving portions 432 are respectively provided in front and rear of the air guide 440 and elevated from an undersurface of the supporting plate 430. A left-right width of each of the bracket receiving portions 432 corresponds to an interval between the motor brackets 330. Therefore, the motor brackets 330 are installed to the inside of the bracket receiving portions 432.

An outer circumference of the air guide 440 is stepped. That is, the air guide 440 is formed such that an upper-half thereof is less than a lower-half thereof. A stepped surface between the upper-half and the lower-half may be inclined with respective to a horizontal level so that the air can more effectively flow.

A plurality of reinforcing ribs 434 are formed on a top surface of the supporting plate 430. That is, the plurality of reinforcing ribs 434 are formed to enhancing strength of the supporting plate 430.

In more detail, the reinforcing ribs 434 extend in a radial direction, e.g., from a lower end of the air guide 440 to respective four corners of the supporting plate 430 formed in the rectangular shape.

Front and rear ends of the supporting plate 430 are hooked on the respective longitudinal supports 310. To realize this, the front and rear ends of the supporting plate 430 are formed to correspond in a shape to the longitudinal supports 310.

Figure 6:
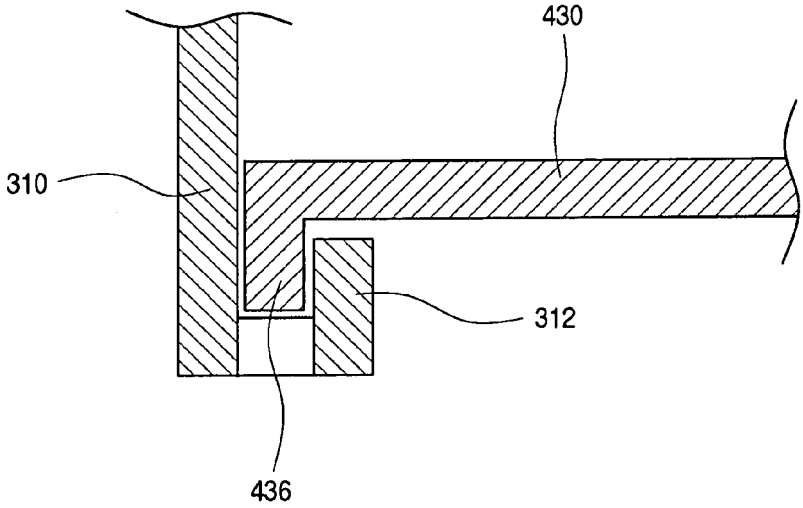
FIG. 6 is a sectional view illustrating installation of a shroud depicted in FIGS. 2 and 5.

In more detail, as shown in FIG. 6, each of the longitudinal supports 310 is provided with a "u" shape hook 312 and each of the front and rear ends of the supporting plate 430 is provided with a "⌈" shape hook end 436. Therefore, as the hook ends 436 are interlocked with the respective hooks 312 and thus the shroud 420, 422 is supported on the longitudinal support 310.

Figure 7:
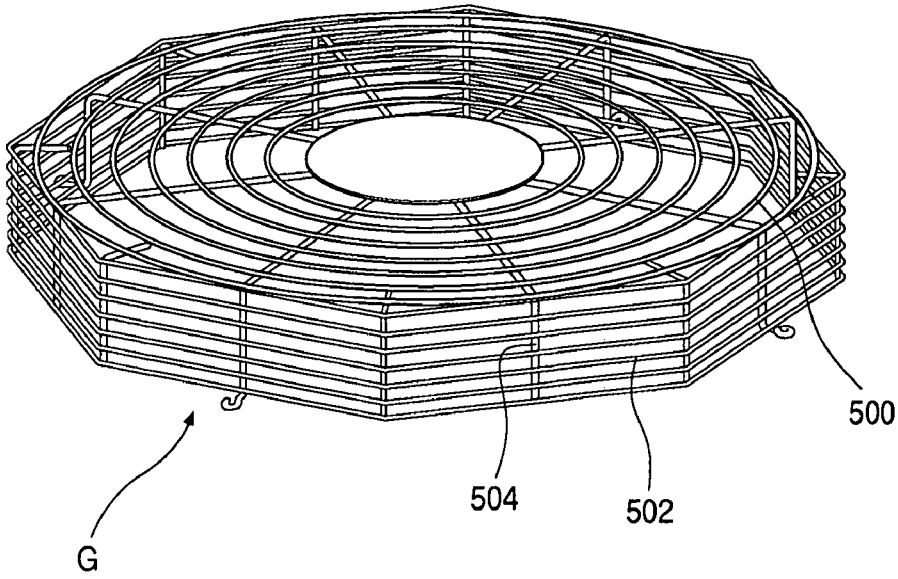
FIG. 7 is a perspective view of an outlet grill G depicted in FIGS. 1 and 2.

FIG. 7 is a perspective view of an outlet grill G depicted in FIGS. 1 and 2.

As shown in FIG. 7, the outlet grill G serves to prevent foreign substances from entering through the outlet 284 and has generally a polygonal plane section.

The outlet grill G includes a plurality of circular ribs 500 defining a top surface, a plurality of side ribs 502 defining a side surface, and a plurality of supporting ribs 504 connecting the circular ribs 500 to the side ribs 502.

The circular ribs 500 are spaced apart from each other by a predetermined distance. Also, the side ribs 502 are spaced apart from each other by a predetermined distance. The distance between the adjacent circular ribs 500 is different from the distance between the adjacent side ribs 502.

In more detail, the distance between the adjacent circular ribs 500 defining the top surface is greater than the distance between the adjacent side ribs 502 such that the side surface of the outlet grill G is more densely formed than the top surface of the outlet grill G.

The reason for more densely forming the side surface than the top surface is to prevent the safety-related accident. That is, a user may inadvertently reach the side surface of the outlet grill G. This may cause the safety-related accidents. Therefore, in order to prevent the safety-related accident, the distance between the side ribs 502 is less than the distance between the adjacent circular ribs 500. In this case, a sufficient air passage can be formed through the top surface.

Although embodiments have been described with reference to a number of illustrative embodiments thereof, it should be understood that numerous other modifications and embodiments can be devised by those skilled in the art that will fall within the spirit and scope of the principles of this disclosure.

What is claimed is:

1. An outdoor unit for an air conditioner, the outdoor unit comprising:

a base assembly defining a lower exterior of the outdoor unit and supporting a plurality of parts;

left and right panels that are provided on the base assembly to define left and right exteriors of the outdoor unit;

a pair of top panels that are provided between upper ends of the left and right panels to define a top exterior of the outdoor unit;

a blower assembly including a blower fan generating air current and a motor providing a torque to the blower fan;

a frame assembly supporting the blower assembly and including a pair of transverse supports interconnecting the left and right panels and a motor mount disposed between the pair of transverse supports to support the motor; the motor mount comprising:

a pair of motor brackets that are disposed between the pair of transverse supports and a motor seating plate provided between the pair of motor brackets, the motor seating plate having ends fixed on the pair of motor brackets and a central portion configured to extend from the ends downwardly; and a shroud enclosing the blower fan and the motor and guiding airflow generated by the blower fan, the shroud comprising:

a supporting plate mounted on the frame assembly;

an air guide configured to extend from the supporting plate upwardly: and bracket receiving portions provided in a side of the air guide and configured to elevate from a surface of the supporting plate.

2. The outdoor unit according to claim 1, wherein each of the motor brackets is provided with a guide stopper protruding upward and guiding the motor seating plate to a right position by catching an end of the motor seating plate.

3. The outdoor unit according to claim 1, wherein the motor seating plate is provided with a motor opening in which the motor is installed and an air hole formed apart from the motor opening to guide the airflow.

4. The outdoor unit according to claim 3, wherein the motor opening is provided with a wire passing groove through which an electric wire passes.

5. The outdoor unit according to claim 1, wherein the cylindrical air guide is stepped such that an upper-half with reference to a stepped portion is less than a lower-half with reference to the stepped portion.

6. The outdoor unit according to claim 5, wherein a plurality of reinforcing ribs are formed on a top surface of the supporting plate, extending in a radial direction from a lower end of the cylindrical air guide.

7. The outdoor unit according to claim 1, wherein front and rear ends of the supporting plate are formed to correspond in a shape to the transverse supports so that the front and rear ends are interlocked with the transverse supports.

8. The outdoor unit according to claim 1, wherein the top panel is provided with an air outlet through which air is discharged and a polygonal outlet grill for preventing foreign substances from entering is provided above the air outlet.

9. The outdoor unit according to claim 8, wherein the outlet grill includes a plurality of circular ribs spaced apart from each other by a predetermined distance and defining a top surface, a plurality of side ribs spaced apart from each other by a predetermined distance and defining a side surface, and a plurality of supporting ribs connecting the circular ribs to the side ribs.

10. The outdoor unit according to claim 9, wherein a distance between the adjacent circular ribs is greater than the distance between adjacent side ribs.

* * * * *